US006202364B1

(12) United States Patent
Fredette

(10) Patent No.: US 6,202,364 B1
(45) Date of Patent: Mar. 20, 2001

(54) PREFABRICATED SELF-SUPPORTING BUILDING STRUCTURE

(76) Inventor: Bernard Fredette, 10 Chemin du lac, Léry, QC (CA), J6N 1A1

( * ) Notice: Subject to any disclaimer, the term of this patent is extended or adjusted under 35 U.S.C. 154(b) by 0 days.

(21) Appl. No.: 09/435,696

(22) Filed: Nov. 8, 1999

(51) Int. Cl.[7] ..... E04H 15/44

(52) U.S. Cl. ..... 52/79.5; 52/70; 52/79.4; 52/64; 52/69

(58) Field of Search ..... 52/64, 69, 70, 52/79.4, 79.5; 135/100

(56) References Cited

U.S. PATENT DOCUMENTS

| | | | | |
|---|---|---|---|---|
| 337,180 | * | 3/1886 | McCoy | 52/69 |
| 2,835,931 | * | 5/1958 | Sterkin | 52/70 |
| 3,016,115 | * | 1/1962 | Harrison et al. | 52/70 |
| 3,346,998 | * | 10/1967 | Nelson | 52/70 |
| 3,442,057 | * | 5/1969 | Derr | 52/70 |
| 3,534,513 | * | 10/1970 | Aitken | 52/70 |
| 3,714,749 | * | 2/1973 | Aitken | 52/70 |
| 3,759,277 | * | 9/1973 | Glade | 135/4 R |
| 3,773,061 | * | 11/1973 | Berger | 135/1 |
| 3,913,285 | * | 10/1975 | Helfrich | 52/64 |
| 4,171,600 | * | 10/1979 | Whitney, Jr. | 52/745 |
| 4,951,432 | * | 8/1990 | Wilkinson | 52/81 |
| 5,566,514 | * | 10/1996 | Freller | 52/79.5 |

* cited by examiner

*Primary Examiner*—Carl D. Friedman
*Assistant Examiner*—Phi Dieu Tran A
(74) *Attorney, Agent, or Firm*—Swabey Ogilvy Renault; Guy J. Houle

(57) ABSTRACT

A prefabricated self-supporting building structure and method of construction is described. The building structure comprises a plurality of substantially triangular shaped panels which are interconnected to one another by a hinge connector and along certain edges thereof whereby to form collapsible roof segments. There are four roof segments in the building structure. The triangular shaped panels are interconnected to form two pre-assembled collapsible panel sections each incorporating a pre-assembled roof segment and panel sections for adjacent roof segments. These two pre-assembled panel sections are erected by simple cable attachments which may be secured to a vehicle and these are interconnected back-to-back. The roof segments are also secured by brackets at their junction points of the panels for securing the roof segments in elevated position on supports. The panels of the two pre-assembled panel sections are also foldable one on top of the other in juxtaposition and therefore the entire roof structure is easy to transport and easy to erect on site.

11 Claims, 5 Drawing Sheets

PREFABRICATED SELF-SUPPORTING BUILDING STRUCTURE

TECHNICAL FIELD

The present invention relates to a prefabricated self-supporting building structure consisting of a plurality of substantially triangular shaped panels which are interconnected to form roof segments which are easy to erect and to connect together.

BACKGROUND ART

Various prefabricated building structures are known and the majority of these comprise pre-casted or pre-assembled panel structures which are transported to an erection site and assembled. Although many of the component parts of the buildings are pre-fabricated, the erection time can be fairly lengthy and inclement weather conditions can further slow down the erection time as well as expose building materials to rain or snow which sometimes will cause the materials to become damaged. Often, the pre-assembled parts are difficult to transport and the transport vehicle must be operated at slow speed, particularly in a situation where an entire home is prefabricated in two sections. They require long trailer vehicles and special vehicles to warn oncoming traffic of the danger of the wide load on the transport vehicle.

Another disadvantage of prefabricated structures is that they are heavy to manipulate and often require large cranes which are expensive. Many of the prefabricated or other type home or building structures are constructed for permanent installation and cannot be easily dismantled and reassembled on another site. A still further disadvantage of prefabricated structures is that often these are not very structurally sound and can become damaged if exposed to tornadoes or hurricane force winds. A still further disadvantage is that some of these structures are erected directly on a slab of cement which is poured on the ground and therefore are easily exposed to flooding with resulting serious damage. Some of these are also not well insulated or resistant to insect infestation such as by termites. Often, their construction causes condensation to set into the structure which can also affect building materials. Still further prefabricated building structures require expensive foundations made of concrete thereby increasing the cost of the prefabricated structure.

Typical examples of prefabricated structures can be found in U.S. Pat. Nos. 5,960,593; 5,950,374; 5,758,461; 4,660,332; 5,904,005; 5,921,047; 4,741,133; 4,912,891; 5,765,316; 5,797,224 and 5,461,832.

SUMMARY OF INVENTION

It is a feature of the present invention to provide a prefabricated self-supporting building structure and a method of erecting such building structure and which substantially overcomes the above-mentioned disadvantages of the prior art.

According to the above features, from a broad aspect, the present invention provides a prefabricated, self-supporting, building structure which is comprised of a plurality of substantially triangular shaped panels. Each of the panels has a front edge, a straight top edge, a straight hypotenuse edge and a junction point at an intersecting end of the hypotenuse edge and the front edge. The panels are connected in juxtaposed pairs by a hinge connection means which interconnects the top edge of each juxtaposed pair of panels to form a collapsible roof segment. There are four roof segments interconnected together in side-by-side relationship at right angles to one another to form the building structure. Each panel of the juxtaposed pairs of panels are connected along their straight hypotenuse edge by a further hinge connection means to the straight hypotenuse edge of a panel of an adjacent roof segment. Attachment means is provided at the junction point of the panels for securing the roof segments in elevated position on a support means. Connector means are provided at a forward end of the top edge of at least one panel of two of the roof segments interconnected back-to-back for attachment to pulling means. The pulling means causes the panel segments to be erected to form a roof structure anchored at the attachment means.

The method consists essentially of connecting the attachment means at the junction point of the roof segments of two panel sections to a support means and connecting a pulling cable to the connector means at a forward end of the top edge of the roof segment of two panel sections. The two panel sections are erected back-to-back by pulling the cable with the further panels of each of the two panel sections having their straight top edge at right angles to the straight top edge of its associated roof segment. Adjacent ones of the top edge of the further panels are secured together by ridge capping connection means whereby to secure the two panel sections together back-to-back and to form a building structure having four roof segments disposed at right angles to one another.

Floor segments can also be secured under the building structure and connected to the roof segments.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
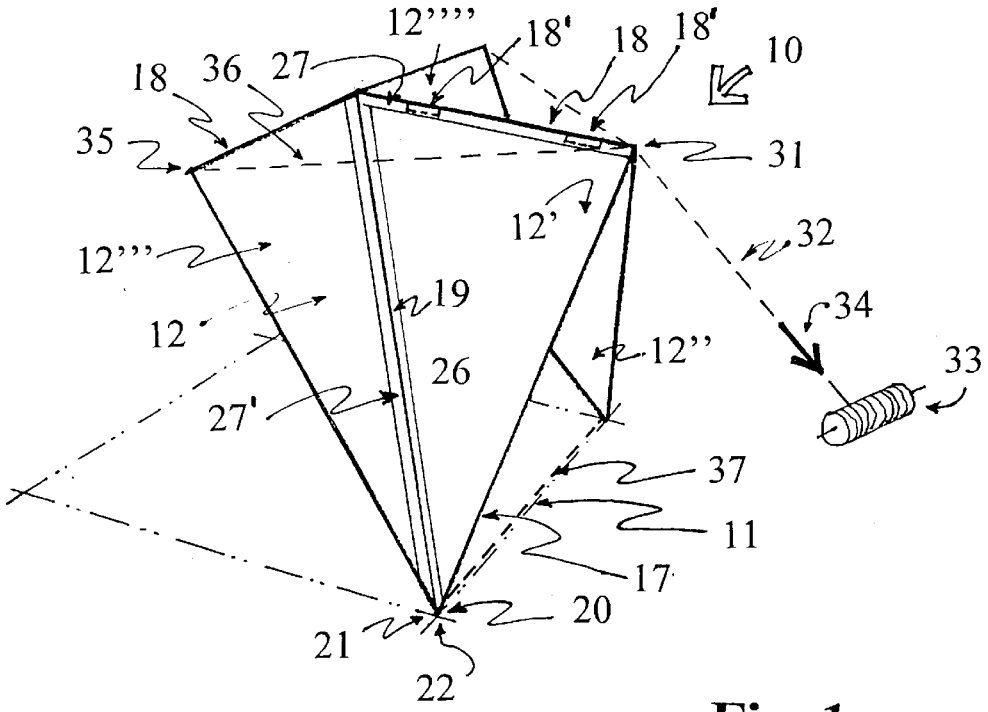
FIG. 1 is a perspective view showing the panels connected together to form a roof segment and one of two pre-assembled panel sections.
Figure 2:
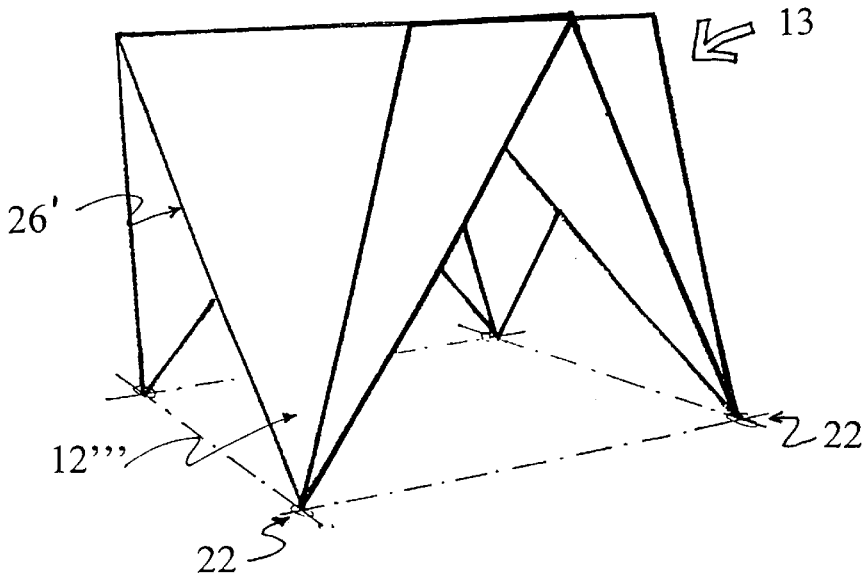
FIG. 2 is a perspective view showing the prefabricated, self-supporting building structure of the present invention in an erected secured position.
Figure 3:
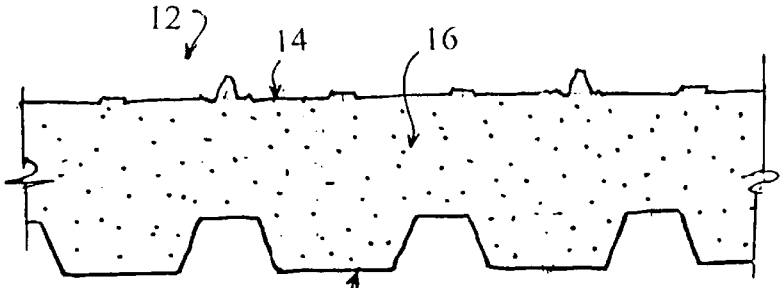
FIG. 3 is a section view showing a typical construction of the panels.

Referring now to the drawings and more particularly to FIG. 1, there is shown generally at 10 a building structure segment 11 pre-assembled with the substantially triangular shaped panels 12 of the present invention whereby to form the pre-assembled panel sections, two of which are required to be interconnected to erect the complete building frame structure of the present invention, as shown at 13 in FIG. 2. The substantially triangular shaped panels 12, as shown in FIG. 3, may be formed of steel roof cladding 14 on an outer surface thereof and a steel deck cladding 15 on an inner surface thereof. A foam core 16 is injected between the claddings 14 and 15 to form an insulated panel structure. The foam 16 may be a polyisocyanurate or a polyurethane foam or any other insulating rigid foam material. Accordingly, these panels are fairly light and easy to manipulate while the corrugation in these panels provide excellent structural properties and the foam core provides good structural and insulating properties.

As shown in FIG. 1, each of the panels 12 has a front edge 17, a straight top edge 18 and a straight hypotenuse edge 19. A junction point 20 is formed at an intersecting end of the hypotenuse edge 19 and the front edge 17. Attachment means in the form of securing brackets 21 are connected to adjacent panels 12 and 12' at the junction point 20 whereby to secure the erected structure, as shown in FIG. 2, to a support means 22, herein a ground anchor 23. These ground anchors 23 are better illustrated in FIG. 4, and as can be seen, they consist of a screw-type anchor rod 23 which is driven into the ground 24 and which resists pulling forces applied on the building structure 25 formed with the roof segment structures 13, shown in FIG. 2 of the present invention.

Referring again to FIG. 1, there is shown the pre-assembled panel section 10 which consists of a roof segment 26 which is formed by connecting in juxtaposed pairs two panels 12' and 12" by hinge connection means, which may be adhesively or mechanically secured to opposed edge sections of the opposed panels 12' and 12" along their straight top edge 18 or opposed hypotenuse edges 19. Hinge plates 18' are secured to opposed inner edge surfaces of the top edge 18 of the panels. After erection, a ridge cap 27 may be secured externally over the top edge 18. Various other forms of hinge connection means could be substituted and it is within the ambit of the present invention to cover any other obvious hinge structures.

The pre-assembled panel section 10 also comprises a panel 12''' of an adjacent roof segment 26', see FIG. 2, to be formed. These panels 12''' are connected respectively to the juxtaposed panels 12' and 12" by a further hinge connection means herein constituted by a further flexible adhesive tape 27'.

Figure 7A:
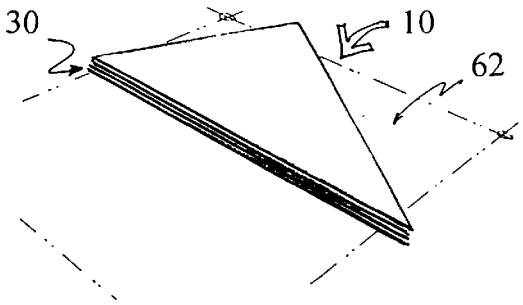
FIGS. 7A to 7J are perspective illustrations showing the sequence of erecting the building structure of the present invention starting from juxtaposed, pre-assembled panels assembled together to form one of two panel sections and illustrating the steps in the assembly of the building structure.

With specific reference to FIG. 7A, it can be seen that the panels 12''' may be folded on their associated respective panels 12' and 12" and also the panels 12' and 12" may be folded upon themselves to form a stack 30 of juxtaposed folded substantially triangular shaped panels, making them easy to transport.

Figure 4:
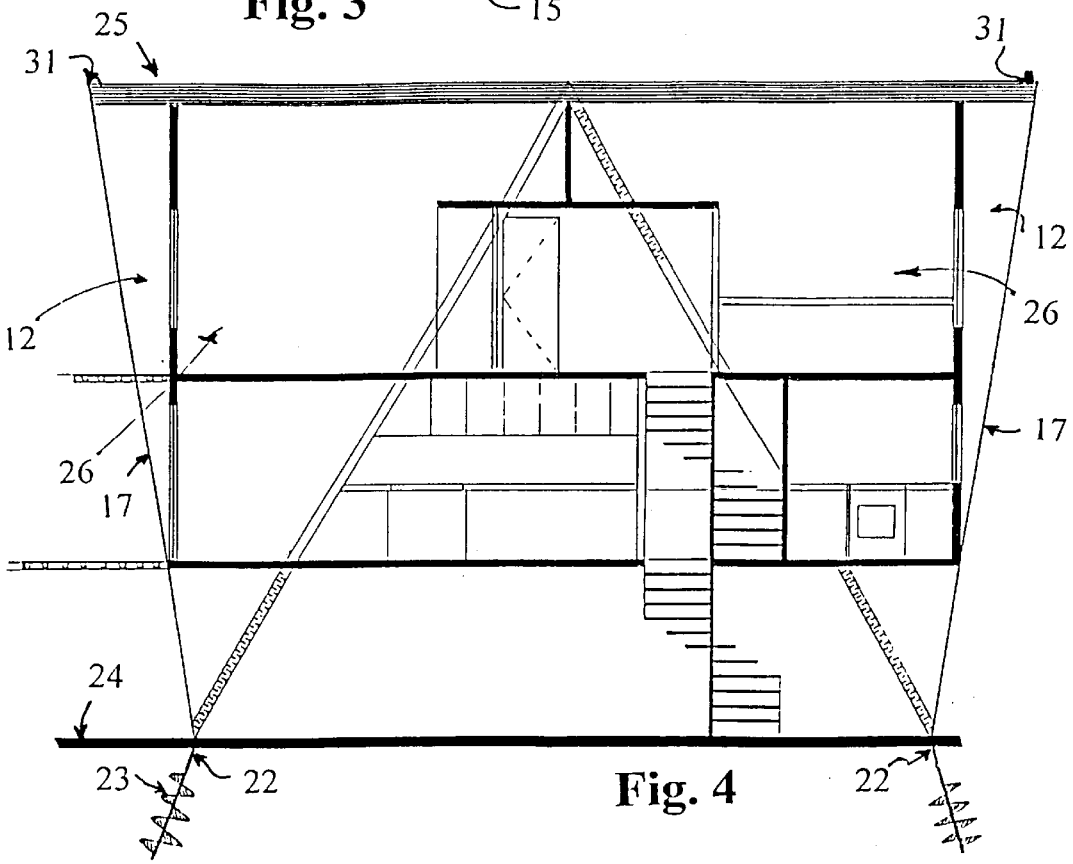
FIG. 4 is a fragmented view, partly in section, showing the roof structure of the present invention erected and segmented internally to form a building structure having two floor structures and anchored into the soil by ground anchors.

As shown more clearly in FIG. 4, anchor means in the form of steel anchors 31 may be secured to the panels 12 and 12' adjacent their straight top edge 18 and forwardly of the roof segment 26 at its forward end, that is to say near the front edge 17 of the triangular panels 12. As shown in FIG. 1, a cable 32 is secured to the anchors 31 and to a winch 33 to apply a forward pulling force in the direction of arrow 34 whereby to erect the pre-assembled panel section 10 on the ground anchors 22 after the securement brackets 21 are pivotally secured to the ground anchors. Further connectors 35 are also secured adjacent the top edge 18 of the adjacent panels 12''' whereby to secure a further spacer cable 36 of predetermined length whereby when the pre-assembled panel section 10 is erected, these side panels 12''' will be maintained hinged out with their top edge 18 aligned and extending substantially transverse to the top edge 18 of the roof segment 26. A further spacer cable 37 of predetermined length is also attached between the securement brackets 21 at the junction point 20 of the adjacent panels 12' and 12" to limit the spacing between these panels when in an open position.

Figure 7B:
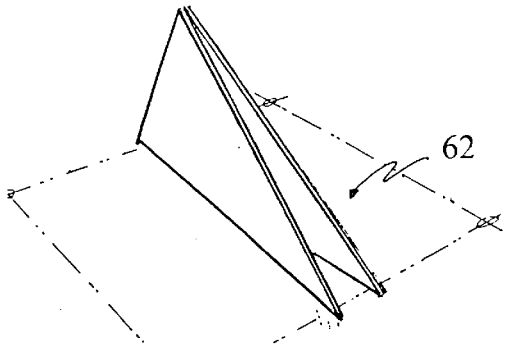
Figure 7C:
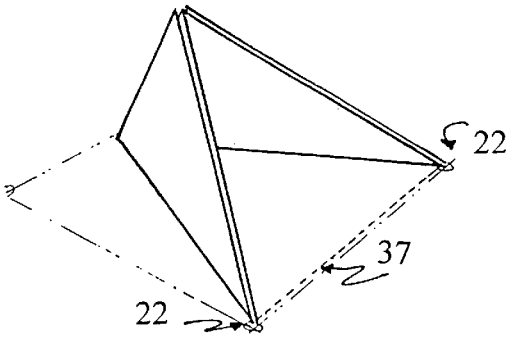
Figure 7D:
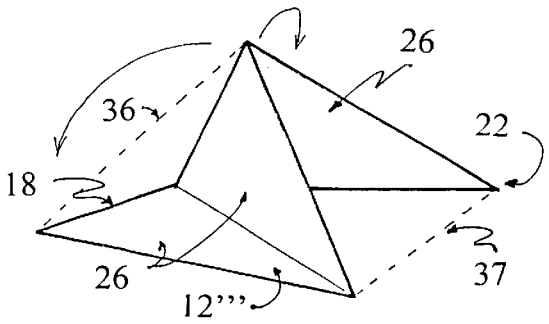
Figure 7E:
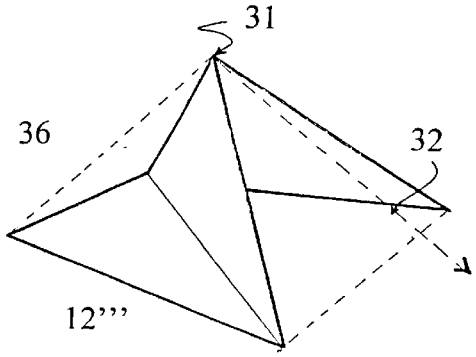
Figure 7F:
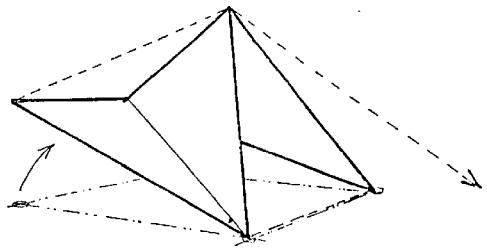
Figure 7G:
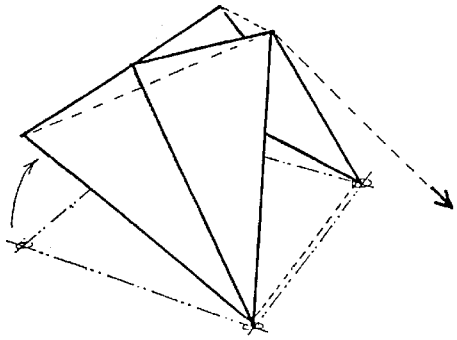
Figure 7H:
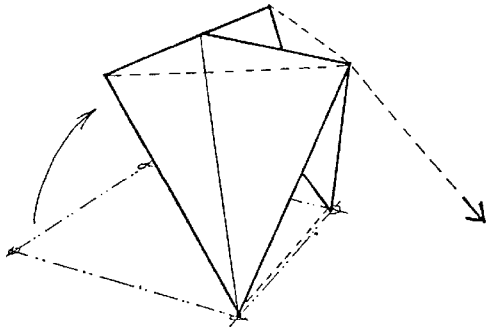
Figure 7I:
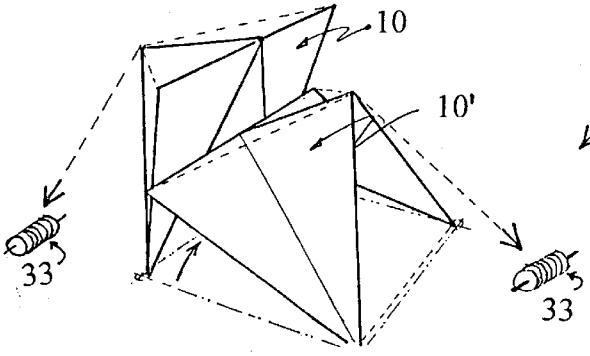
Figure 7J:
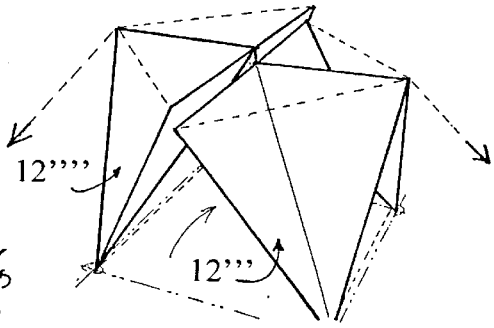

In order to construct the building structure as shown in FIG. 2, there is required two such pre-assembled panel sections 10 and these are erected back-to-back, as illustrated in FIGS. 7I and 7J and these are erected simultaneously in a similar fashion. By the pivoting action of the pre-assembled panel sections 10 which are positioned back-to-back and by movement of the winch 33, these sections can be brought together with the top edges 18 of the adjacent panels 12''' in substantially perfect alignment. The ridge cap 27, or other type connection, is then applied to the top edge 18 of adjacent panels 12''' of the two pre-assembled panel sections 10 placed back-to-back and this completes the securement of the structure. Internal braces (not shown) may also be secured to the inner face of the roof structure to solidify its connections should this building structure be utilized as a canopy, as shown in FIG. 2, for another structure to be positioned thereunder or for any other purpose.

Figure 6:
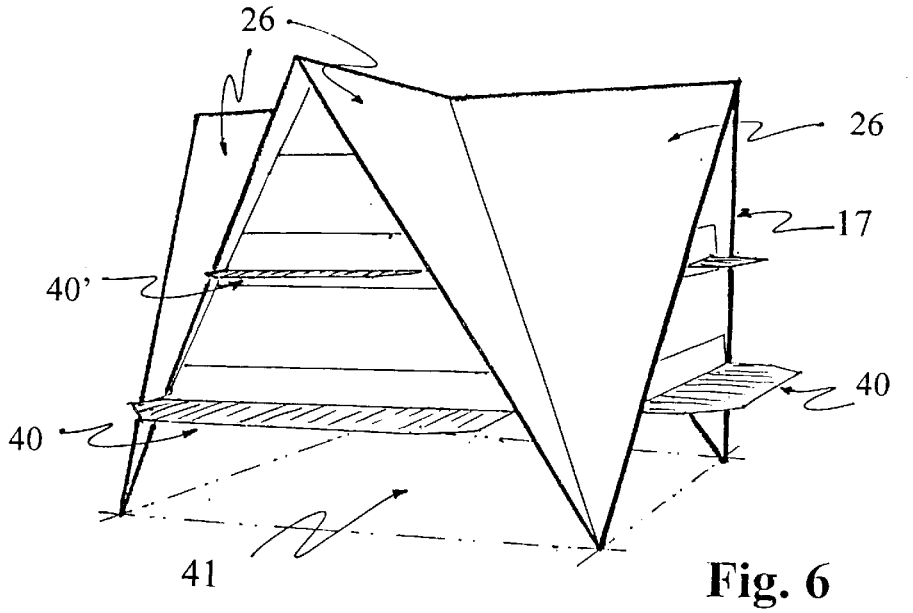
FIG. 6 is a perspective view showing the prefabricated roof structure of the present invention used in the construction of a multi-tenant building structure.

As shown in FIGS. 4 and 6, the building structure is herein shown formed as a residential building and prefabricated floor structures 40 are brought into position and secured to the inner surface of the panels 12 by suitable anchor means (not shown). Two such floor structures may be secured to constitute a dwelling having two floors and, of course, if this roof structure is fairly large, it can accommodate four dwellings, each of which is associated with one of the roof segments 26, there being four roof segments in this building structure with the axes of their top edge extending transverse to one another. Such structures would be convenient to construct low cost housing or temporary housing as the structure can be easily disassembled and transported elsewhere. It is also pointed out that such structures are very resistant to earthquakes, hurricanes, tornadoes, termites, the formation of condensation, etc. Also, because the lower floor may be used as a parking space, as shown at 41 in FIG. 6, the main floor is elevated sufficiently high so that the building structure can resist flooding. The lower section or the entire triangular panels could also be constructed in a waterproof fashion or at least the lower ends thereof below the main floor 40', and dependent on the geographic location of the structure.

Figure 5A:
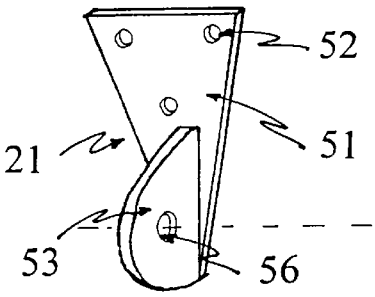
FIG. 5A is a perspective view showing a typical construction of a securement bracket secured to the junction point at an intersecting end of the hypotenuse edge and the front edge of the panel.
Figure 5B:
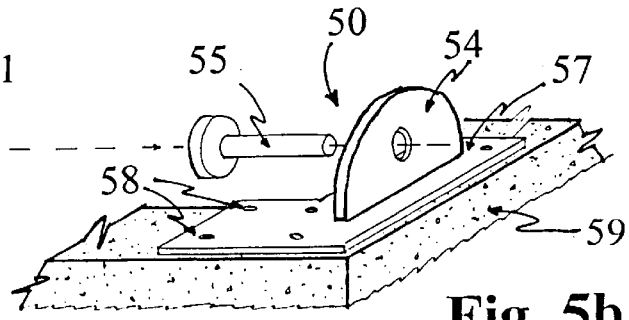
FIG. 5B is a perspective view of a support wall anchor secured to a foundation or pile.

Referring to FIGS. 5A and 5B, there is shown a typical construction of a securement bracket 21 and an anchor bracket 50. The securement bracket 21 may be in the form of a triangular shaped steel plate 51 having holes 52 therein to receive fasteners to secure it to the panel at the junction point area 20 thereof as shown in FIG. 1. This area may also be reinforced. A connecting flange 53 extends forwardly of the bracket 51 and extends at a predetermined angle so that adjacent brackets 21 of adjacent panels can be secured to the projecting tongue 54 of the anchor bracket 50 by extending on both sides of the tongue and by securing a bolt 55 through the flanges 53 and the tongue 54. This constitutes a pivotal connection. The anchor bracket 50 also has a base plate 57 provided with holes 58 to secure same to corners of a foundation wall 59 or to the attachment end 22 of the anchor rods 23. Numerous other forms of brackets and anchors can be constructed to secure the roof segments of the building structure. Also, when the structure is erected on a foundation 59 as shown in FIG. 5B, the roof structure can be erected elevated from the ground surface. The collapsed panels would be placed on a floor flush with the foundation and tilted up on its convectors.

Figure 8:
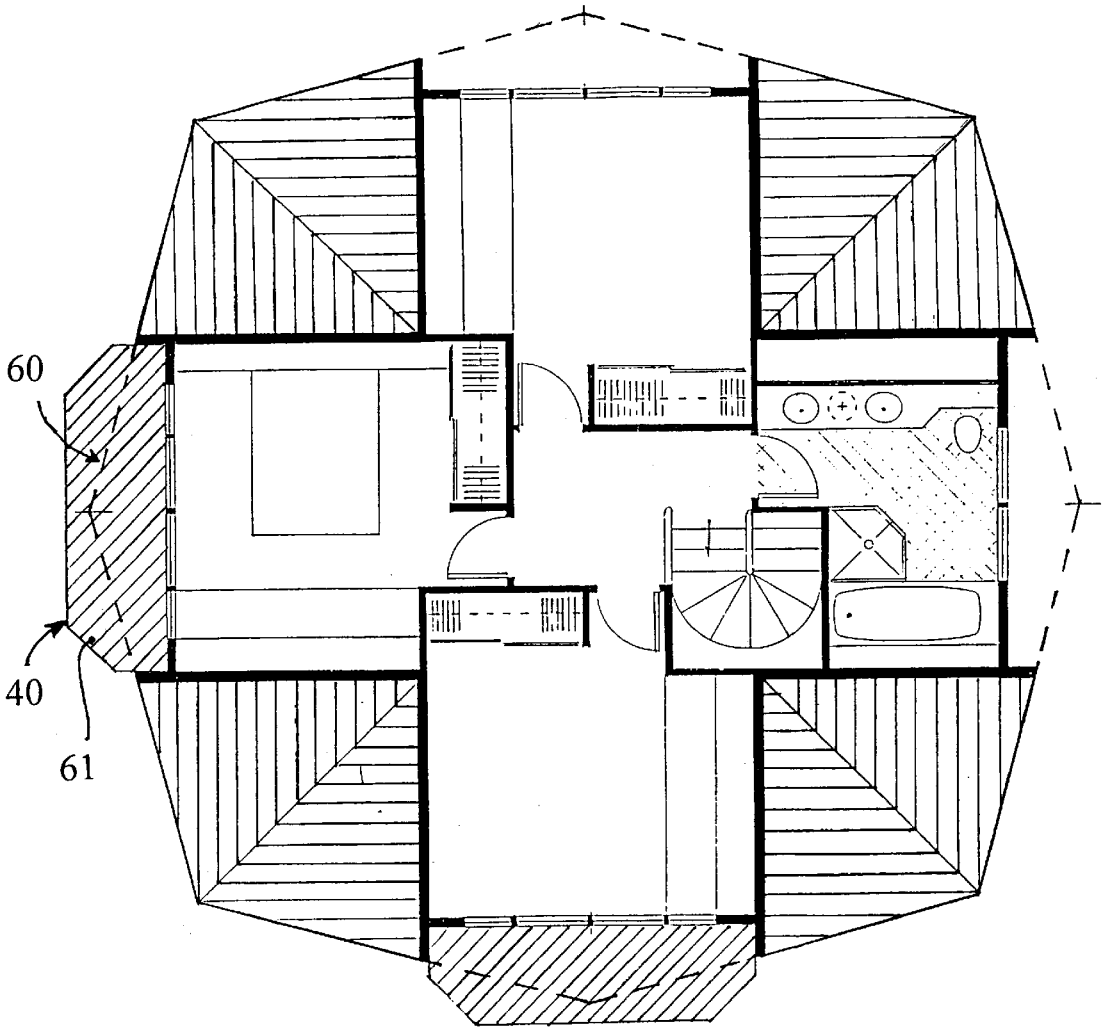
FIG. 8 is a typical floor plan view of one of the floors of the building structure.

FIG. 8 shows a typical floor plan for a floor of a two-story dwelling and the illustration is self-explanatory. It is also pointed out, with further reference to FIG. 6, that the front edge 17 of the roof segments need not be straight but could have a forward projection in a top portion thereof extending at a different angle whereby to constitute an overhanged roof section, as illustrated by phantom lines 60 in FIG. 8 that project over a balcony 61 which is preformed with the prefabricated floor 40 to substantially shield it from rain or sun.

With reference to FIGS. 7A to 7J, there will be described the manner in which the roof structure of the present invention is erected. A first stack 30 of assembled panels constituting a first pre-assembled panel section 10 is brought on a site 62 where the roof structure is to be assembled. The panels are lifted vertically and separated as shown in FIG. 7B until the junction points 22 are fully extended as delimited by the base spacer cable 37, as shown in FIG. 7C. This positioning of the panels can be effected by a small group of people. As shown in FIGS. 7B and 7C, once the roof segment starts separating, it then supports itself. The side panels 12''' are then folded out to each side of the roof segment 26 and laid on the ground. The spacer cable 36 maintains the straight top end 18 of the side panels 12''' extending substantially perpendicular to the top end 18 of the roof segment 26 and in substantial axial alignment with the top end 18 of the adjacent side panel 12'''.

As shown in FIG. 7E, the pulling cable 32 is then secured to the steel anchor 31 and to a winch 33. However, before doing so, the securement brackets 21 have been attached to the anchor brackets 50 so as to provide a pivotal connection. The winch is actuated to pull the panels to cause them to rise in the fashion as shown in FIGS. 7F to 7H. A second stack of panels are positioned behind the raised pre-assembled panel section 10 and the same procedure is repeated by raising the other pre-assembled panel section 101, as shown in FIG. 7I, by forward movement of another winch 33'. The winches are maneuvered to bring the top edge of the side panels 12''' of the back-to-back pre-assembled panel sections 10 and 101 in substantial alignment with one another. The top edges of adjacent panels are then secured by one or more ridge caps 27, as previously described, to complete the structure. The cables can then be removed. Typically, such a roof structure can be erected very quickly and within a few hours.

It is within the ambit of the present invention to cover any obvious modifications of the preferred embodiments described herein, provided such modifications fall within the scope of the appended claims.

What is claimed is:

1. A prefabricated self-supporting building structure comprising a plurality of substantially triangular shaped panels; each said panel having a front edge, a straight top edge, a straight hypotenuse edge and a junction point at an intersecting end of said hypotenuse edge and said front edge; said panels being connected in juxtaposed pairs by a hinge connection means interconnecting said top edge of each juxtaposed pair of panels to form a collapsible roof segment, there being four such roof segments interconnected together in side-by-side relationship at right angles to one another to form said building structure, each panel of said juxtaposed pair of panels being connected along their said straight hypotenuse edge by a further hinge connection means to said straight hypotenuse edge of a panel of an adjacent roof segment, attachment means at said junction point of said panels securing said roof segments in elevated position on a support means, connector means at a forward end of said top edge of at least one panel of two of said roof segments interconnected back-to-back attaching to pulling means, said pulling means causing said panel segments to be erected to form a roof structure anchored at said attachment means wherein there is further provided cable anchor means secured to said straight top edge of said panel of an adjacent roof segment, and a top edge spacer cable secured between said anchor means and said connector means of said one of said back-to-back roof segments.

2. A prefabricated self-supporting building structure as claimed in claim 1 wherein said building structure is segmented in two pre-assembled panel sections, each said pre-assembled panel section being comprised of one of said back-to-back roof segments and a panel of an adjacent roof segment adjacent each said pair of panels of said one of said back-to-back roof segments connected thereto along said straight hypotenuse edge by said further hinge connection means whereby to form a stack of pre-assembled collapsed panels all foldable juxtaposed and constituting a half building structure.

3. A prefabricated self-supporting building structure as claimed in claim 2 wherein said hinge connection means comprised of a flexible sheet material interconnected to opposed edge sections of said panels and bridging adjacent straight hypotenuse edges of said panels.

4. A prefabricated self-supporting building structure as claimed in claim 2 wherein said attachment means are securement brackets secured to anchor brackets secured to said support means.

5. A prefabricated self-supporting building structure as claimed in claim 4 wherein said support means is a ground anchor.

6. A prefabricated self-supporting building structure as claimed in claim 4 wherein said support means is a support wall anchor.

7. A prefabricated self-supporting building structure as claimed in claim 2 wherein said pulling means is a cable secured to said connector means and to a winch to erect said stack of pre-assembled collapsed panels on said attachment means of said back-to-back roof segments.

8. A prefabricated self-supporting building structure as claimed in claim 7 wherein there is further provided a base spacer cable secured between said attachment means of said pair of panels of each said back-to-back roof segments to prevent said juxtaposed pair of panels to be displaced from one another beyond a predetermined distance.

9. A prefabricated self-supporting building structure as claimed in claim 8 wherein said back-to-back roof segments have their interconnected top edge secured in alignment along a first straight axis, said opposed roof segments interconnected therewith by said hinge connection means also having their interconnected top edge secured in alignment along a second straight axis which extends transverse to said first straight axis from mid-length thereof.

10. A method of erecting a building structure comprising the steps of:

i) providing a plurality of substantially triangular shaped panels; each said panel having a front edge, a straight top edge, a straight hypotenuse edge and a junction point at an intersecting end of said hypotenuse edge and said front edge;

ii) connecting said panels connected in juxtaposed pairs by a hinge connection means interconnecting said top edge of each juxtaposed pair of panels to form a collapsible roof segment;

iii) connecting a further panel which is to form an adjacent roof segment on opposed sides of said roof segment with a further hinge connection means interconnecting adjacent straight hypotenuse edges of each said juxtaposed panels of said roof segment and a respective one of said further panels of adjacent roof segments to be formed to form a pre-assembled collapsible panel section;

iv) forming a second of said pre-assembled collapsible panel sections;

v) connecting an attachment means at said junction point of said roof segments of said two panel sections to a support means and providing a pivotal connection;

vi) connecting a pulling cable to a connector means at a forward end of said top edge of said roof segment of said two panel sections;

vii) erecting said two panel sections back-to-back by pulling on said cable with said further panels of each said two panel sections having their straight top edge at right angles to said straight top edge of its associated roof segment;

viii) securing adjacent ones of said top edge of said further panels with ridge capping means to form a roof structure having four roof segments disposed at right angles to one another.

11. A method as claimed in claim 10 wherein there is further provided the step of securing prefabricated floor structures under said roof structure to form one or more building enclosures.

* * * * *